United States Patent [19]

Compton

[11] 4,231,080

[45] Oct. 28, 1980

[54] LUMINAIRE WITH REFLECTING LOUVERS

[75] Inventor: Wayne W. Compton, Irvine, Calif.

[73] Assignee: Kim Lighting, Inc., City of Industry, Calif.

[21] Appl. No.: 889,193

[22] Filed: Mar. 23, 1978

[51] Int. Cl.[3] ..... A47B 19/00

[52] U.S. Cl. ..... 362/298; 362/346; 362/349

[58] Field of Search ..... 362/98, 298, 302, 305, 362/343, 346, 347, 349

[56] References Cited

U.S. PATENT DOCUMENTS

| | | | |
|---|---|---|---|
| Re. 29,017 | 10/1976 | Hildenbrandt | 362/302 |
| 1,876,667 | 9/1932 | Gunnison | 362/346 X |
| 1,881,525 | 10/1932 | Halpern | 362/346 X |
| 2,327,219 | 8/1943 | Rowland | 362/305 X |
| 3,215,829 | 11/1965 | Collins et al. | 362/302 |
| 3,359,415 | 12/1967 | Lasker | 362/303 X |
| 3,593,014 | 7/1971 | Vesely | 362/309 X |
| 3,836,767 | 9/1974 | Lasker | 362/303 X |
| 4,096,555 | 6/1978 | Lasker | 362/302 |

FOREIGN PATENT DOCUMENTS

| | | | |
|---|---|---|---|
| 414733 | 8/1934 | United Kingdom | 362/346 |

*Primary Examiner*—Peter A. Nelson

*Attorney, Agent, or Firm*—Donald D. Mon

[57] ABSTRACT

An optical louver luminaire having at least three stacked reflector members each of which is at least in part a surface of revolution, all centered on a common vertical axis. Each reflector has a central opening to receive a light source. The light source has a region of major luminance with an upper end and a lower end. The lower one of the reflector members cuts off light from the upper end of the region to determine the lower-most vertical angle of direct illumination, and others of the reflector members determine the cut-off angle of the greatest vertical angle. The optical luminaire casts a combination of doubly reflected and directly transmitted light to produce a light distribution on the ground with intensities that increase as the vertical angle increases to a pre-determined angle. If desired, parts of the reflector members may be replaced by asymmetrical reflector members to provide for asymmetrical light distribution.

6 Claims, 5 Drawing Figures

60
88
84
61
65
83
76
63
87
62
64
170
81
82
75
186
185
66
86
71
73
187
72
80
70
180
$W_2$

LUMINAIRE WITH REFLECTING LOUVERS

This invention relates to a compact type luminaire such as a bollard or small area light. They characteristically have a relatively small diameter, and are intended to be placed either close to the ground to provide for illumination of pathways, or relatively high above the ground on poles to provide for large area illumination.

It is an objective of conventional luminaires to provide a relatively uniform illumination over a substantial area on the ground, and at the same time to cut off light above a given vertical angle. The latter reduces light pollution. This is an unexpectedly difficult problem to solve, especially in a compact luminaire of sensibly small size, and even more so when the luminaire must be located close to the ground where a relatively high maximum vertical angle of intensity is desirable.

It is an object of this invention to provide a compact optical system wherein accurate upper and lower cut off means is provided and in which a substantially more uniform illumination is provided on the ground than is available with conventional luminaries of comparable size.

Luminaires utilizing a plurality of reflectors are known. For example they are shown in Lasker U.S. Pat. No. 3,836,767, issued Feb. 26, 1973. One problem with luminaires of this class is that in order to be made of a sensible size they can provide only a relatively small area of illumination. That is to say their maximum vertical cut-off angle is relatively low. Classically, they utilize but a single aperture for the distribution of their light, and as consequence both the diameter and the height of such a luminaire are excessive. A luminaire according to this invention utilizes a plurality of such apertures utilizing three or more reflector members, and provides the said advantages in a compact luminaire of relatively small envelope both as to height and as to diameter. Stated otherwise, in luminaires of the same size, a larger area of illumination can be provided from the same elevation, together with the advantages of this invention.

A luminaire according to this invention utilizes at least three horizontal reflector members. Each of said reflector members is a surface of revolution around and centered on a vertical axis for at least a substantial portion of its periphery. These portions are co-axial. The reflector members are axially spaced apart from one another, and each one of them has a central opening to receive a lamp whose radiation is to be directed by the reflector members. The lamp is of the type which has a region of major luminous intensity with an upper end and a lower end, the region extending from end to end for a substantial distance along the vertical axis. The reflectors are axially spaced apart to form a first lower aperture between first and second ones of the reflector members, and a second aperture between second and third ones of said reflector members. Both of these apertures permit direct exit of light, and also permit double reflected light to escape. The double reflected light extends from the upper maximum included angle to some lesser angle, and the direct light fills in the lower angles.

The above and other features of this invention will be fully understood from the following detailed description and the accompanying drawings in which:

FIG. 1 shows the presently preferred embodiment of the invention and the best known mode for practicing it. In the form illustrated, it is intended to utilize a standard High Intensity Discharge lamp, and to be affixed either to a high or a low pole at the top thereof.

Figure 1:
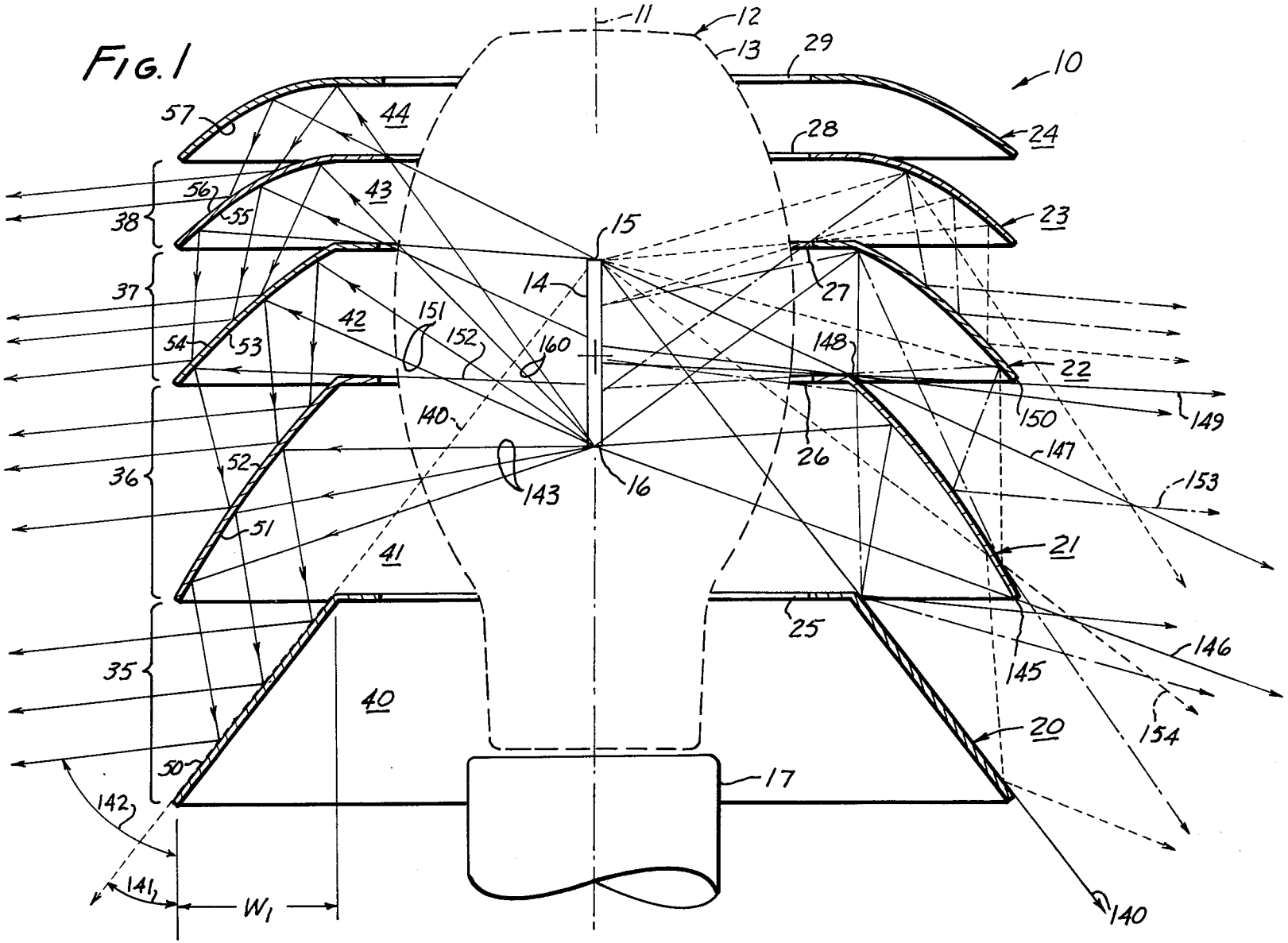
FIG. 1 is an axial cross-section of the presently preferred embodiment of the invention.

Because this invention refers to the optical system, the means for holding this device together and for mounting it to a pole are not shown. Such means are generally known in the art. For example, if a number of the reflector members are to be interconnected, this can be done by bolts and spacers passing through all of them, or they might be individually attached to extensions of the pole itself. The lamp will be connected to some kind of conventional circuitry to provide for its illumination. Because these details form no part of the invention, they are not described here.

The luminaire 10 extends along a vertical axis 11 and surrounds a lamp 12. Persons skilled in the art will recognize the lamp envelope 13 as a 70 watt High Intensity Discharge type lamp which includes an arc member 14 that comprises a "region of major luminous flux." It has an upper end 15 and a lower end 16, and the region between these ends is where the arc exists to provide luminous flux that passes through the transparent envelope. This embodiment of the invention is particularly adapted for use with transparent i.e., non-frosted and non-coated envelopes. A socket 17 is provided to receive the lamp and it is connected into conventional circuitry not shown.

The region of major luminance extends from the upper end to the lower end along the central axis, for a substantial distance, often about 6 inches.

The luminaire comprises a plurality of reflector members i.e., a first reflector member 20, a second next-above reflector member 21, a third next-above reflector member 22, a fourth next-above reflector member 23, and a fifth next-above reflector member 24. These reflector members are arranged in a stack, and they are axially spaced apart from one another. Reflectors 20, 21, 22, 23 and 24 have respective central openings 25, 26, 27, 28 and 29 to accommodate and to clear the lamp.

A first aperture 35 is formed between the first and second reflector members. A second aperture 36 is formed between the second and third reflector members. A third aperture 37 is formed between the third and fourth reflector members. A fourth aperture 38 is formed between the fourth and fifth reflector members.

Each of the reflector members has a portion which is a surface of revolution generated around the central axis. These are portions 40, 41, 42, 43 and 44 in reflector members 20, 21, 22, 23 and 24. In this embodiment, which is intended for a full peripheral illumination i.e., illumination in a circular pattern around the pole, the "portions" constitute the entire reflector members. In an asymmetrical device yet to be described, the portions will constitute less than the entire periphery.

The first reflector member 20 has an upper surface 50 which is specularly reflective. The second reflector member has a lower surface 51 and an upper surface 52 which are specularly reflective and in this embodiment are respectively concave downwardly and convex upwardly. Third reflector member 22 has a lower surface 53 and an upper surface 54 which are specularly reflective and are respectively concave downwardly and convex upwardly. Fourth reflector member 23 has a lower surface 55 and an upper surface 56 which are respectively concave downwardly and concave upwardly. The fifth reflector member 24 has a lower surface 57 which is specularly reflective and is concave downwardly. These surfaces occupy the said "portions" and are at least portions of respective surfaces of revolution. A reference dimension $W_1$ is shown in FIG. 1, which will be referred to hereafter.

Figure 2:
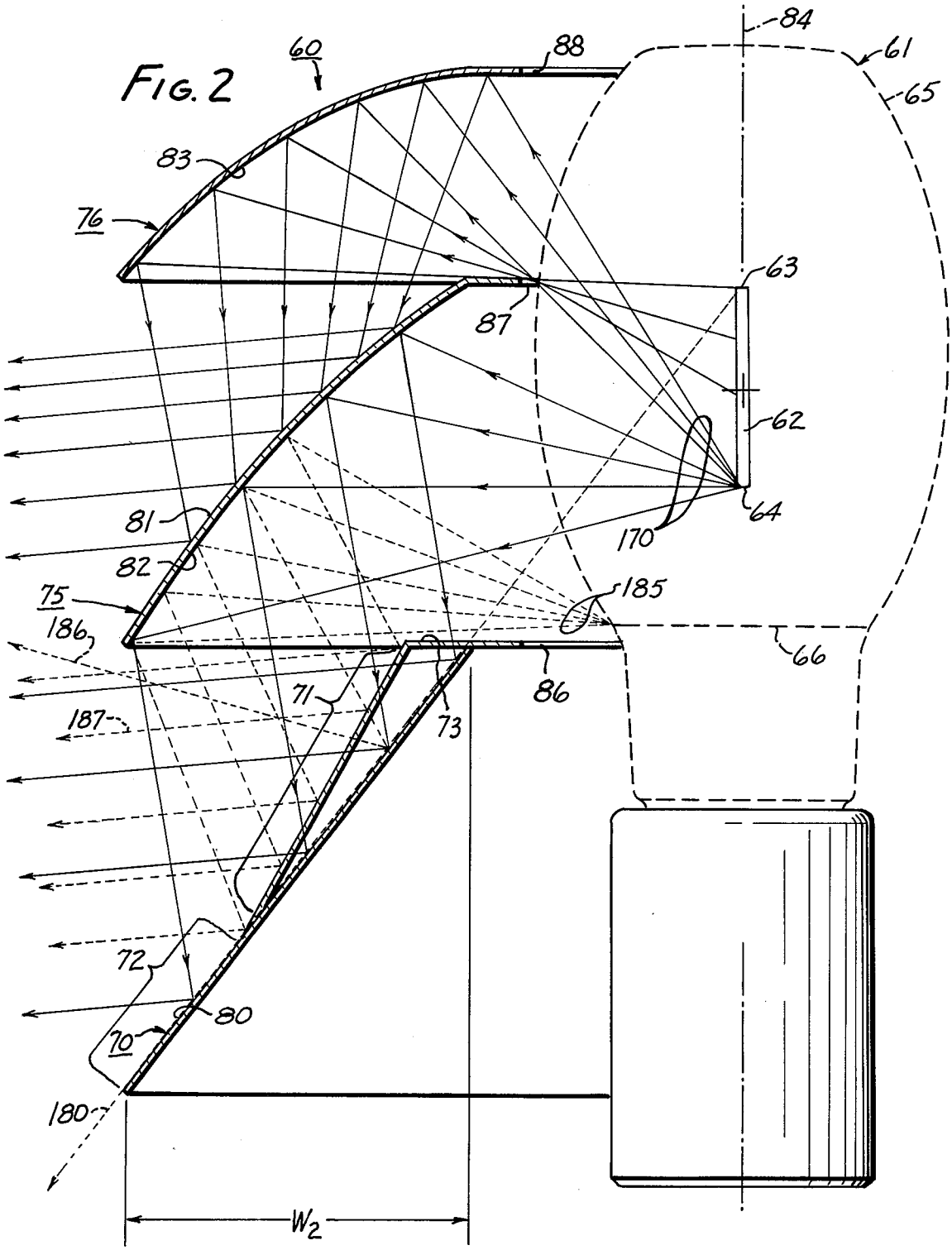
FIG. 2 is half of an axial cross-section of another embodiment of the invention, also including a modification thereof.

FIG. 2 shows a simplified embodiment of the invention incorporating the least number of reflector members. Instead of five reflector members, it has only three reflector members. While it is about the same height as the device of FIG. 1 it has a reference dimension $W_2$ which is about double the dimension $W_1$, to emit light at about the same upper and lower cut-off angles. Thus, a lesser number of parts can be used at the penalty of a larger diameter for the luminaire.

The luminaire 60 of FIG. 2 is also built around a lamp 61 with the same features as lamp 12 in FIG. 1. It also includes a region of major luminance provided by an arc member 62 with an upper end 63 and a lower end 64 when a clear envelope 65 is used. FIG. 2 also illustrates an alternative construction which is utilized when frosted or phosphor coated lamps are used. In this latter situation, the lower end 66 of the phosphor coating is shown and the phosphor coating extends to or near the upper end of the lamp. The entire surface of the envelope above line 66 is then the region of major luminance. The top of the frost or coating is the upper end, and line 66 is the lower end. Under these circumstances a different shape will be given to the first reflector.

When used with a clear-envelope lamp, the luminaire includes a first reflector member 70 which is the frusto-conical member formed by the single continuous straight edge in FIG. 2. When a frosted or phosphor coated lamp is used, then the first reflector member includes a first frusto-conical zone 72 (which is part of the first reflector member already shown), and a second curved surface zone 71 which ends at a flat terminal plate 73 at its upper end. The second zone has a lesser included conical angle than the first zone. It provides a more appropriate distribution of doubly reflected light from coated and frosted lamps.

A second reflector member 75 is next above the first reflector member, and a third reflector member 76 is next above the second reflector member.

Upper surface 80 of first reflector member 70 is specularly reflective. The upper surface 81 and lower surface 82 of second reflector 75 are specularly reflective and in the illustrated embodiment are respectively convex upwardly and concave downwardly. The lower surface 83 of third reflector member 76 is specularly reflective and concave downwardly. The said upper and lower surfaces comprise "portions" of the reflector members which are surfaces of revolution generated around the central axis 84 of the luminaire.

Central openings 86, 87, 88 are provided in the reflector members 70, 75, and 76 to accommodate and to clear the lamp.

Figure 3:
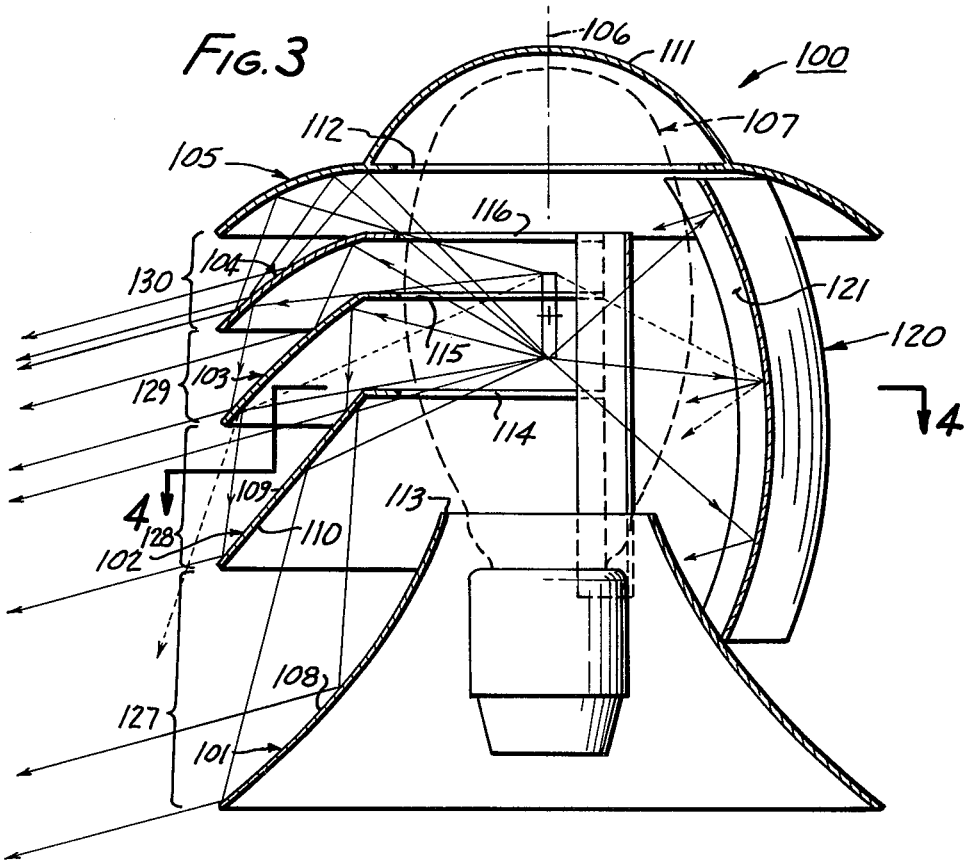
FIG. 3 is an axial cross-section of still another embodiment of the invention, taken at line 3—3 in FIG. 4.

In FIG. 3, a luminaire 100 is shown which is a modified form of the luminaire of FIG. 1. It includes first, second, third, fourth and fifth reflector members 101, 102, 103, 104 and 105. These all include portions which are surfaces of revolution coaxial with one another and centered on axis 106. A lamp 107 with the features of lamp 12 is fitted within the luminaire as before. First reflector 101 differs from first reflector 24 in that its upper surface 108 is concave upwardly rather than the frustum of a cone. The second reflector differs from second reflector member 21 in that its upper surface 109 and lower surface 110 are frusto-conical rather than concavo-convex. The third, fourth and fifth reflector members are substantially identical to reflector members 22, 23 and 24 in FIG. 1. A hat member 111 covers the central opening 112 in the fifth reflector member. The first through fourth reflector members have central openings 113, 114, 115 and 116, respectively.

Figure 4:
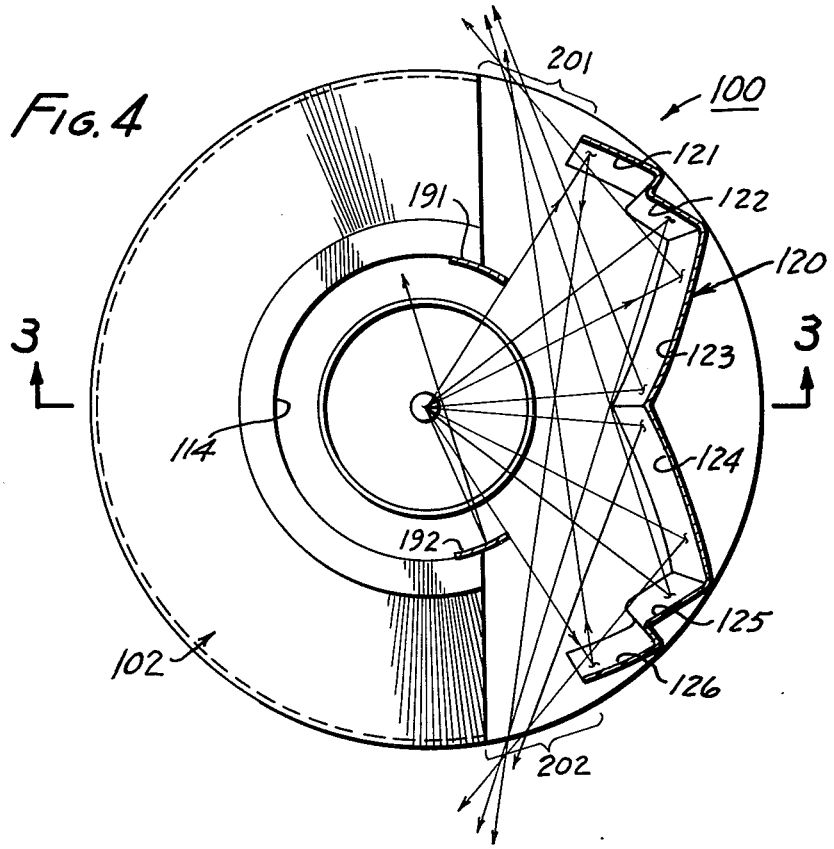
FIG. 4 is a cross-section taken at line 4—4 in FIG. 3.
Figure 5:
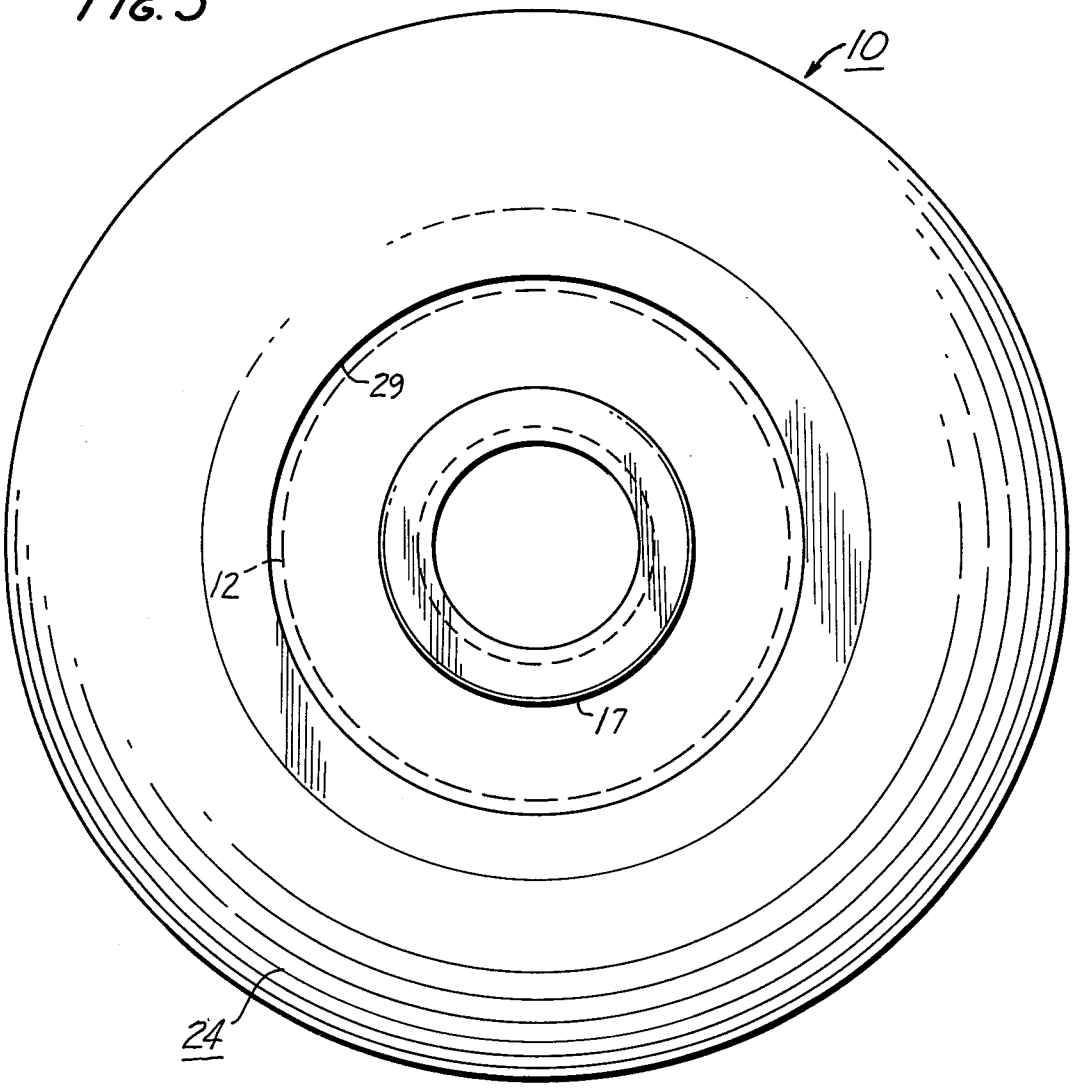
FIG. 5 is a top view of FIG. 1.

This embodiment differs most importantly from that which is illustrated in FIG. 1 in that it is shown equipped to provide for an asymmetrical distribution with light concentration to the sides. This is optional, and the reflector members with the profiles shown could instead extend completely around the axis and provide for a symmetrical distribution, rather than an asymmetrical distrubution. For the asymmetrical distribution, the second, third and fourth reflector members are not complete surfaces of revolution but instead are only portions thereof. This leaves a cut out portion which accommodates an asymmetrical reflector 120. This reflector is preferably crenelated as shown in FIG. 4. Whether crenelated or not, it is generally concave as it faces toward the central axis. It includes six reflector surfaces 121, 122, 123, 124, 125 and 126. They are also generally concavely curved in the vertical plane. They are provided for intercepting a substantial portion of the luminous flux which otherwise would pass out of the apertures to the right hand side of the luminaire as viewed in FIG. 3, and instead reflect it to the left. Apertures are provided between the reflector members as follows: first, second, third and fourth apertures 127, 128, 129 and 130 respectively between the first and second, second and third, third and fourth, and fourth and fifth of the reflector members. Cylindrical segments 191 and 192 are provided to shield direct light from openings 201 and 202. Segments 191 and 192 are specularly reflective to reflect light which impinges on them.

The functioning of the luminaire of FIG. 1 may best be understood by first considering the first grazing ray 140 which emanates from the upper end 15 of the region of major luminance. This ray grazes the frusto-conical surface 50 and is not reflected by it. It follows that light from below upper end 15 will not directly impinge on surface 50. Therefore, the grazing ray defines a cut off at a minimum vertical angle 141 for directly-escaping light, which in a practical bollard luminaire can be approximately 38° half-angle (76° conical included angle). Therefore, the first reflector member functions as a limiting cut-off member for directly emitted light. It is evident that in a practical luminaire, when a concave-upward, or a frusto-conical reflecting surface is used, the upper or the lower edge will probably function as the actual cut-off means. The "grazing ray" shown is an idealized situation, where both edges of the surface are in line with the grazing ray.

Further as to the first aperture, light from lower end 16 sequentially strikes surfaces 51 and 50 and is thereby doubly reflected to emit from the luminaire at a maximum vertical angle 142 for doubly reflected light which in a practical bollard luminaire might be on the order of 85° half-angle (170° conical included angle). Rays departing from positions intermediate between the upper and lower ends 15 and 16 are reflected out at some angle equal to or lower than the maximum vertical angle.

Examination of the emanating rays from bundle 143 of rays departing from the lower end of the region will show that the emitted rays are substantially parallel. This results in a substantial intensity of light at the outer extreme of the distribution provided by the luminaire.

Limiting ray 144 is shown just grazing the outer edge 145 of the second reflector. This edge limits the upper angle 146 for direct light escape from the first aperture to one wherein the light is beneath the maximum vertical angle for reflected light.

The second aperture acts in much the same way as the first aperture. Limiting ray 147 just grazes edge 148 on the second reflector. It emanates from the upper end of the said region. Limiting ray 149 emanates from an intermediate point in the region and grazes edge 150 on the third reflector member to determine the uppermost limit of directly-escaping light. Rays in bundle 151 of rays emitted from the lower end of the region are shown being doubly reflected through the second aperture. A ray 152 from an intermediate portion is shown directed at substantially the maximum vertical angle. As can be seen from various other exemplary rays, such as rays 153 and 154, doubly reflected rays from various parts of the region emit from the second aperture at varying angles between the cut off extremes.

In the third aperture, there is no direct escape of light because the central opening 27 in the third reflector member is at an elevation at or above the upper end of said region. The reflecting portions of the third and fourth reflector members are shaped so that rays 160 from the lower end depart at approximately 85° (170° conical angle) and the other rays from the region depart at the same or lesser angles. It is preferred that in the third and fourth apertures the rays depart principally at and near the maximum vertical angle in order to provide for a maximum luminance at greater distances from the central axis. The function in the fourth aperture is substantially the same as in the third aperture. By making the unit intensity greater at the higher angle, then more uniform illumination will be provided on the ground. Totally uniform illumination is rarely sought. What is sought is a lesser fall-off of illumination on the ground toward the outer edges of the illuminated pattern, so that there is not an unacceptably great difference from place to place over an area illuminated by a plurality of spaced-apart luminaires.

The doubly-reflected rays are heavily concentrated at the greater distance from the central axis although some are concentrated in lesser intensities closer thereto. Direct light is used as a fill-in which may be adjusted by the vertical height of the apertures so as to provide for optimum illumination.

In FIG. 2 a bundle of rays 170 is shown emanating from the lower end of the said region. These rays are double reflected at the highest vertical angle. The distribution of light resulting from the embodiment of FIG. 2 is substantially the same as the embodiment of FIG. 1. Direct light is emitted through the first aperture from the region above the lower end. Lower ray 180 represents the cut-off for direct illumination when segment 71 is not used. Only member 70 is used. This is the situation when clear lamps are used. The direct illumination will supplement that which reaches the ground by double reflection.

Reflection through the second aperture is similar to that in the third aperture of FIG. 1, and will not be described again.

When a frosted or phosphor coated lamp is utilized, then the two zone construction using both of segments 71 and 72 will be used. The reason for this is shown by the exemplary rays 185 which are emitted from the lower edge of the phosphor coating. Were the second zone not used, and reflection were as shown by ray 186 then there would be too high a reflection. The correcting upper zone is required to eliminate this risk so that ray 187 results instead, which is at or below the upper cut-off angle.

The basic reflecting functions of the surface of revolution portions of the reflector members in FIG. 3 need no further discussion here. However, in FIGS. 1 and 2 the device produces a symmetrical lighting pattern. In the event that an asymmetrical pattern is desired, for example when the luminaire is next to a building and it is not desired to illuminate the building but rather to cast more light on the surrounding area, then an asymmetrical reflector will be provided. Cylindrical segments 191, 192 limit the passage of light to the asymmetrical reflector and reflect light back to the frusto-conical portions but those rays which strike the crenelated portion are reflected out of the luminaire, preferably without passing through the apertures. Instead their reflected rays go in some different directions. The specific configuration of the asymmetrical reflector will be determined by the distribution desired. In the illustrated embodiment, it is intended to light up a longer area to the sides of the device as illustrated in FIG. 4.

The precise dimensions of the luminaires are a matter for the individual designer, having in mind the illumination pattern he desires. The construction shown in FIG. 1 is shown to scale. Its construction may be determined from the drawings utilizing the standard known dimensions of the illustrated lamps and dimension $W_1$ which is $1\frac{3}{8}$ inches. Similarly, in FIG. 2 scaling may be made from the lamp dimension and from the dimension $W_2$ which is $2\frac{3}{4}$ inches. In FIG. 3 dimensions and curves may be determined by reference to the dimensions of the illustrated lamp.

A few general observations may be useful for a better understanding of this invention. In order to reduce the diameter of the luminaire, which is a desirable objective in many architectural applications, this invention provides a plurality of apertures. Especially as constrasted to the Lasker type device, it can also be lower. In order to obtain a broad-area distribution, with a single aperture, it is necessary to provide a tall, steeply shaped pair of reflectors, whose rays must cross over one another to provide the distribution.

The prior art curvature results in a bulky, taller, more-difficult-to-form construction. The reflector members of this invention, however are rather gently curved and relatively shallow. They are simple to make, and the bulk of the luminaire is minimized. It will be observed that the doubly reflected rays existing through a given orifice do not cross over one another as they pass from their first to their second reflection. This aids in keeping down the steepness of the reflector members, and also the head height.

Also, especially when a clear lamp is used, either the first or the second reflector is preferably frusto-conical, and the other concavely formed. In the modification shown for the phosphor coated lamp in FIG. 2, at least part of one of them (segment 72 as illustrated) is frusto-conical.

Furthermore, it is not expected that there will be a sharp line of demarcation between a maximum intensity at the outer edge of the area to be illuminated and an unlighted area. Rather there is a fall-off of illumination at the edge which, while not abrupt is fairly steep.

Furthermore, in FIG. 2 segments 71 and 72 are inner and outer "zones." Segment 71 can be frusto-conical or somewhat concave upwardly as preferred.

This invention thereby provides a means for providing illumination of an area of substantial but not necessarily complete uniformity, but definitely one in which the unit illumination on the ground at a distance from the bollard within its area of illumination is not unacceptedly low. This is caused by concentrating the rays at the farthest distance from the central axis by means of doubly reflecting the rays through a plurality of apertures and by filling in elsewhere as desired by direct emission, which can of course be adjusted or selected by placement of the edges which cut off the limiting rays.

This invention is not to be limited by the embodiments shown in the drawings and described in description which are given by way of example and not of limitation, but only in accordance with the scope of the appended claims.

I claim:

1. A luminaire having a vertical axis, and at least four horizontal reflector members, each said reflector member being a surface of revolution around and centered on said axis for at least a substantial portion of its periphery, said portion being coaxial, said reflector members being axially spaced apart from one another, and each having a central opening to receive a lamp which when energized to emit light emits light in a region of major luminance with an upper end and a lower end, said region extending from end to end for a substantial distance along said vertical axis, said reflectors being axially spaced apart to form a first, lower, aperture between a first, lower, one of said reflector members, and the next-above second one of said reflector members, and a second aperture between said second reflector member and the next-above third one of said reflector members, and a third aperture between said third reflectors member and the next-above fourth one of said reflector members, the upper surface of said portion of said first reflector member being specularly reflective and so shaped, disposed, and arranged as to cut off light from the upper end to define the least vertical angle of directly-emitted light, the lower surface of said portion of said second reflector member being specularly reflective, and so disposed and arranged as to reflect light from said region to the said reflecting surface of the first reflector member so that the first reflector member reflects said light in a pattern extending from a maximum vertical angle for light emitted from said lower end, to a lower angle for light emitted from the region above the lower end, and so as to cut off light from the region above the lower end from direct emission above a maximum vertical angle of directly emitted light, the upper surface of said portion of said second reflector member and the lower surface of said portion of said third reflector member being specularly reflective, at least some direct escape of light being permitted between them, with the third reflector so disposed and arranged as to cut off said direct light at or below said maximum vertical angle of directly-emitted light, said last-named upper and lower surfaces sequentially reflecting light from said lower end at the maximum vertical cut-off angle, and from locations above said bottom end, at lesser vertical angles, whereby light emitted from said first and second apertures is a combination of directly emitted and doubly reflected light cut off at said maximum and minimum vertical angles, the inner margin of said third reflector member and the outer margin of said fourth reflector member axially overlapping to prevent direct escape of light from the luminaire, above 90° horizontal, the upper surface of said portion of the third reflector member and the lower surface of said portion of the fourth reflector member being specularly reflective and respectively convex upwardly and concave downwardly, and so proportioned, disposed, and arranged that sequentially reflected light departs at an angle at or beneath said maximum vertical angle.

2. A luminaire according to claim 1 in which substantially all of the light from the third aperture departs at substantially the selected maximum vertical angle.

3. A luminaire according to claim 1 in which a fifth said reflector having the properties of said fourth reflector forms a fourth aperture having the properties of the third aperture.

4. A luminaire according to claim 3 in which substantially all of the light from the third and fourth apertures departs at substantially the selected maximum vertical angle.

5. In combination: the luminaire of claim 1, and a lamp whose said region comprises an axially extending arc member.

6. In combination: the luminaire of claim 1, and a lamp whose said region comprises a glowing envelope.

* * * * *